US006602153B2

(12) United States Patent
Ogg

(10) Patent No.: US 6,602,153 B2
(45) **Date of Patent: *Aug. 5, 2003**

(54) AERODYNAMIC PATTERN FOR A TWO-PIECE GOLF BALL

(75) Inventor: Steven S. Ogg, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 93 days.

This patent is subject to a terminal disclaimer.

(21) Appl. No.: 09/768,847

(22) Filed: Jan. 24, 2001

(65) Prior Publication Data

US 2001/0006914 A1 Jul. 5, 2001

Related U.S. Application Data

(63) Continuation-in-part of application No. 09/398,919, filed on Sep. 16, 1999, now Pat. No. 6,224,499.

(51) Int. Cl.[7] ..... A63B 37/14
(52) U.S. Cl. ..... 473/383
(58) Field of Search ..... 473/378–384

(56) References Cited

U.S. PATENT DOCUMENTS 4,813,677 A * 3/1989 Oka et al. ..... 15/119.2
4,949,976 A * 8/1990 Gobush ..... 473/378
5,482,286 A * 1/1996 Okamura et al. ..... 473/372
5,846,141 A * 12/1998 Morgan et al. ..... 473/377
5,957,786 A * 9/1999 Aoyama ..... 473/379
6,053,820 A * 4/2000 Kasashima et al. ..... 473/378
6,224,499 B1 * 5/2001 Ogg ..... 473/383
6,299,552 B1 * 10/2001 Morgan et al. ..... 473/384

OTHER PUBLICATIONS

John F. Hotchkiss, 500 Years of Golf Balls History & Collector's Guide, Antique Trader Books, p. 189.*

* cited by examiner

*Primary Examiner*—Steven Wong
*Assistant Examiner*—Raeann Gorden
(74) *Attorney, Agent, or Firm*—Michael A. Catania

(57) ABSTRACT

A dimple pattern for a golf ball with multiple sets of dimples is disclosed herein. Each of the multiple sets of dimples has a different diameter. A preferred set of dimples is twelve different dimples. The dimples may cover as much as eighty-seven percent of the surface of the golf ball. The unique dimple pattern allows a golf ball to have shallow dimples with steeper entry angles. In a preferred embodiment, the golf ball has 382 dimples covering ninety percent of the surface.

9 Claims, 11 Drawing Sheets

AERODYNAMIC PATTERN FOR A TWO-PIECE GOLF BALL

CROSS REFERENCES TO RELATED APPLICATIONS

This application is a continuation-in-part application of U.S. Patent Application Ser. No. 09/398,919 filed on Sep. 16, 1999, now U.S. Pat. No. 6,224,499.

STATEMENT REGARDING FEDERALLY SPONSORED RESEARCH OR DEVELOPMENT

Not Applicable

BACKGROUND OF THE INVENTION

1. Field of the Invention

The present invention relates to a golf ball. More specifically, the present invention relates to a dimple pattern for a golf ball in which the dimple pattern has different sizes of dimples.

2. Description of the Related Art

Golfers realized perhaps as early as the 1800's that golf balls with indented surfaces flew better than those with smooth surfaces. Hand-hammered gutta-percha golf balls could be purchased at least by the 1860's, and golf balls with brambles (bumps rather than dents) were in style from the late 1800's to 1908. In 1908, an Englishman, William Taylor, received a patent for a golf ball with indentations (dimples) that flew better ad more accurately than golf balls with brambles. A. G. Spalding & Bros., purchased the U.S. rights to the patent and introduced the GLORY ball featuring the TAYLOR dimples. Until the 1970s, the GLORY ball, and most other golf balls with dimples had 336 dimples of the same size using the same pattern, the ATTI pattern. The ATTI pattern was an octahedron pattern, split into eight concentric straight line rows, which was named after the main producer of molds for golf balls.

The only innovation related to the surface of a golf ball during this sixty year period came from Albert Penfold who invented a mesh-pattern golf ball for Dunlop. This pattern was invented in 1912 and was accepted until the 1930's.

In the 1970's, dimple pattern innovations appeared from the major golf ball manufacturers. In 1973, Titleist introduced an icosahedron pattern which divides the golf ball into twenty triangular regions. An icosahedron pattern was disclosed in British Patent Number 377,354 to John Vernon Pugh, however, this pattern had dimples lying on the equator of the golf ball which is typically the parting line of the mold for the golf ball. Nevertheless, the icosahedron pattern has become the dominant pattern on golf balls today.

In the late 1970s and the 1980's the mathematicians of the major golf ball manufacturers focused their intention on increasing the dimpled surface area (the area covered by dimples) of a golf ball. The dimpled surface for the ATTI pattern golf balls was approximately 50%. In the 1970's, the dimpled surface area increased to greater than 60% of the surface of a golf ball. Further breakthroughs increased the dimpled surface area to over 70%. U.S. Pat. No. 4,949,976 to William Gobush discloses a golf ball with 78% dimple coverage with up to 422 dimples. The 1990's have seen the dimple surface area break into the 80% coverage.

The number of different dimples on a golf ball surface has also increased with the surface area coverage. The ATTI pattern disclosed a dimple pattern with only one size of dimple. The number of different types of dimples increased, with three different types of dimples becoming the preferred number of different types of dimples. U.S. Pat. No. 4,463 to Oka et al., discloses a dimple pattern with four different types of dimples on surface where the non-dimpled surface cannot contain an additional dimple. United Kingdom patent application number 2157959, to Steven Aoyama, discloses dimples with five different diameters. Further, William Gobush invented a cuboctahedron pattern that has dimples with eleven different diameters. See 500 *Year of Golf Balls*, Antique Trade Books, page 189. However, inventing dimple patterns with multiple dimples for a golf ball only has value if such a golf ball is commercialized and available for the typical golfer to play. Additionally, dimple patterns have been based on the sectional shapes, such as octahedron, dodecahedron and icosahedron patterns. U.S. Pat. No. 5,201,522 discloses a golf ball dimple pattern having pentagonal formations with equally number of dimples therein. U.S. Pat. No. 4,880,241 discloses a golf ball dimple pattern having a modified icosahedron pattern wherein small triangular sections lie along the equator to provide a dimple-free equator.

Although there are hundreds of published patents related to golf ball dimple patterns, there still remains a need to improve upon current dimple patterns. This need is driven by new materials used to manufacture golf balls, and the ever increasing innovations in golf clubs.

BRIEF SUMMARY OF THE INVENTION

The present invention provides a novel dimple pattern that reduces high speed drag on a golf ball while increasing its low speed lift thereby providing a golf ball that travels greater distances. The present invention is able to accomplish this by providing multiples sets of dimples arranged in a pattern that covers as much as eighty-six percent of the surface of the golf ball.

One aspect of the present invention is a dimple pattern on a golf ball in which the dimple pattern has at least eleven different sets of dimples. The golf ball includes first, second, third, fourth and fifth pluralities of dimples disposed on the surface. Each of the first plurality of dimples has a first diameter. Each of the second plurality of dimples has a second diameter that is greater than the first diameter. Each of the third plurality of dimples has a third diameter that is greater than the second diameter. Each of the fourth plurality of dimples has a fourth diameter that is greater than the third diameter. Each of the fifth plurality of dimples has a fifth diameter that is greater than the fourth diameter. The first, second, third, fourth and fifth pluralities of dimples cover at least eighty percent of the surface of the golf ball.

Another aspect of the present invention is a golf ball having at least 382 dimples. The 382 dimples are partitioned into at least eleven different sets of dimples. Each of the eleven different sets of dimples have a different diameter than any other set of dimples. The 382 dimples cover at least 87% of the surface of the golf ball Yet another aspect of the present invention is a golf ball having a core and cover. The core has a diameter of 1.50 inches to 1.56 inches, and is composed of a polybutadiene material. The cover encompasses the core and has a thickness of 0.05 inch to 0.10 inch. The cover is preferably composed of an ionomer blend of material. The cover has a surface which has 382 dimples. The 382 dimples are partitioned into at least eleven different sets of dimples. Each of the eleven different sets of dimples have a different diameter than any other set of dimples. The 382 dimples cover at least 87% of the surface of the cover.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
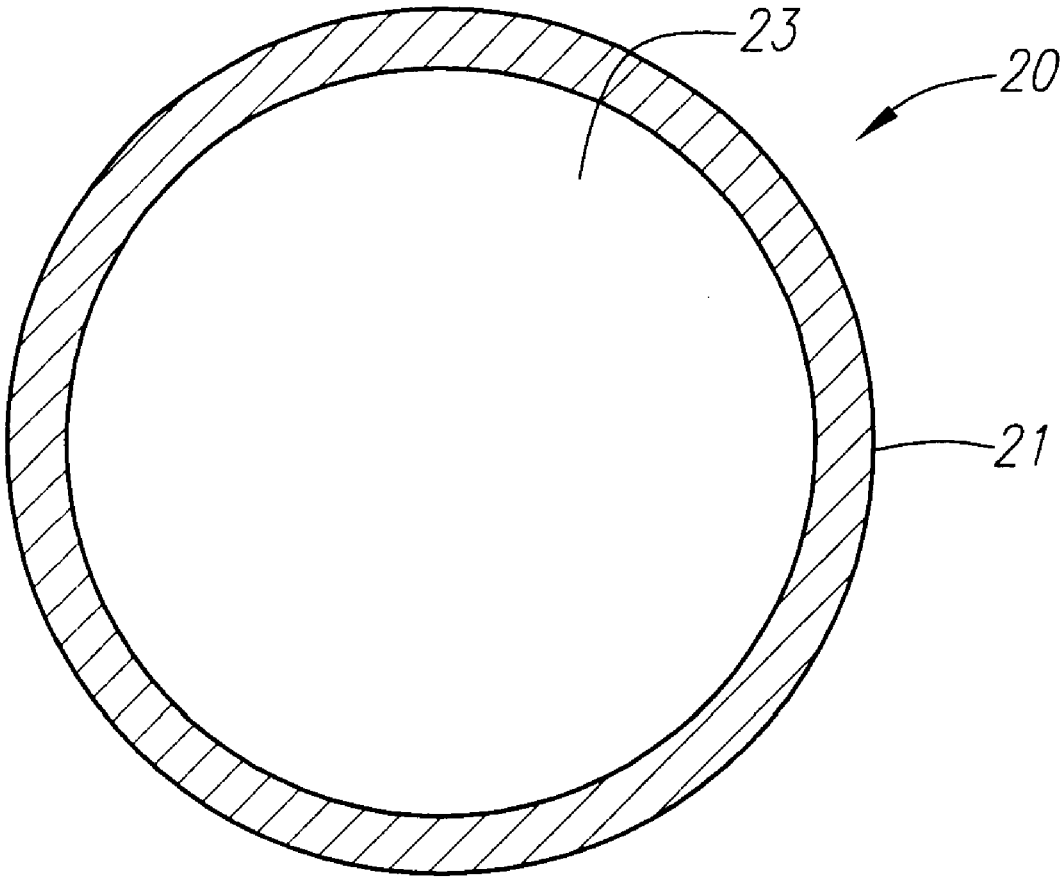
FIG. 1 is a cross-section of a golf ball of the present invention.

As shown in FIG. 1, a golf ball is generally designated 20. The golf ball is preferably a two-piece with a solid core and a cover such as disclosed in co-pending U.S. patent application Ser. No. 09/768,846, for a Golf Ball, filed on Jan. 23, 2001, and incorporated by reference. However, those skilled in the pertinent art will recognize that the aerodynamic pattern of the present invention may by utilized on the three-piece golf ball, one-piece golf ball, or multiple-layer golf ball without departing from the scope and spirit of the present invention.

A cover 21 of the golf ball 20 may be any suitable material. A preferred cover 21 is composed of a thermoplastic material such as an ionomer material. However, those skilled in the pertinent art will recognize that other cover materials may be utilized without departing from the scope and spirit of the present invention. The golf ball 20 may have a finish of a basecoat and/or top coat with a logo indicia. A core 23 of the golf ball is preferably composed of a polybutadiene material.

Figure 2:
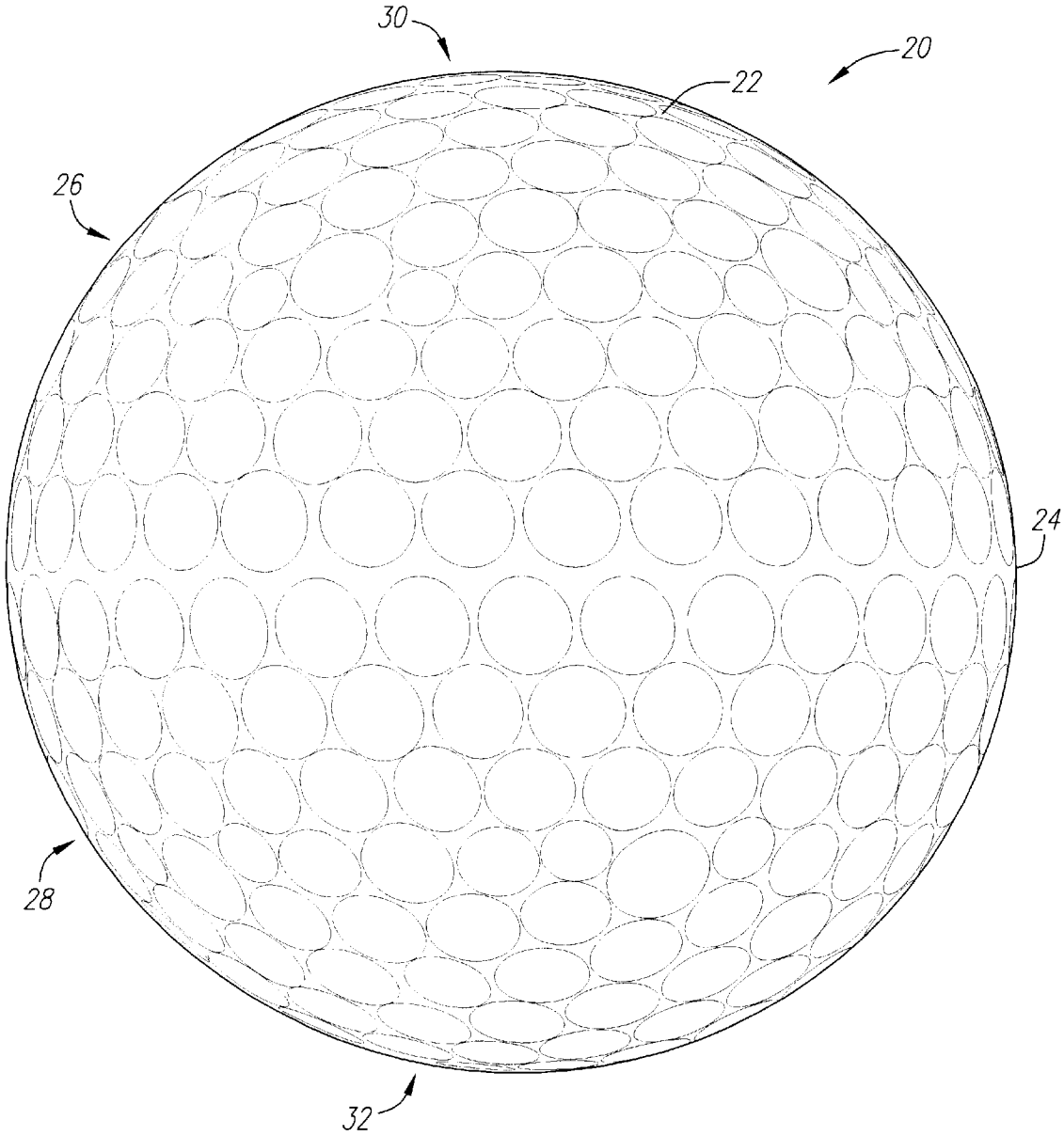
FIG. 2 is an equatorial view of a preferred embodiment of a golf ball of the present invention.
Figure 3:
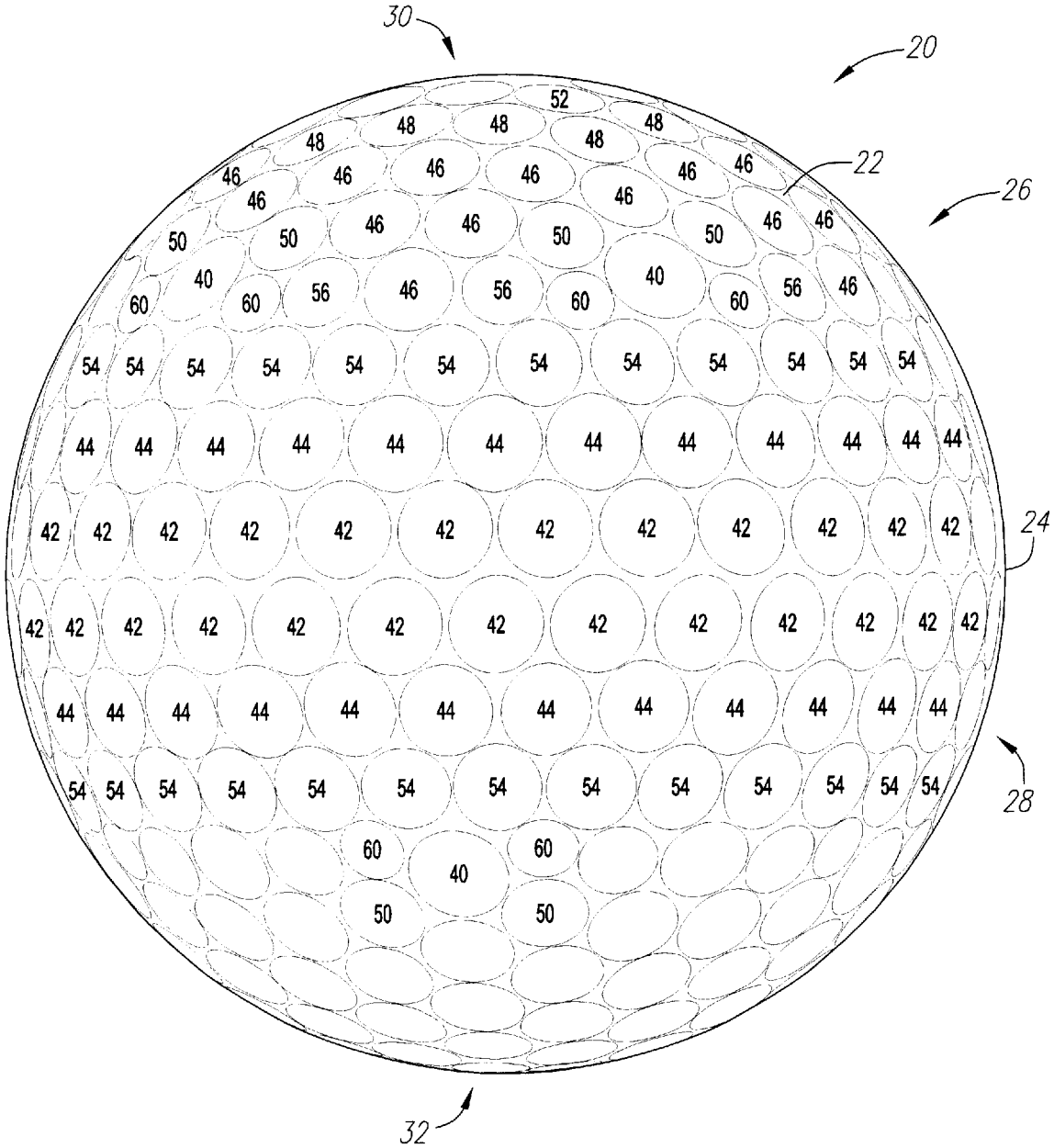
FIG. 3 is an equatorial view of a preferred embodiment of a golf ball of the present invention.
Figure 4:
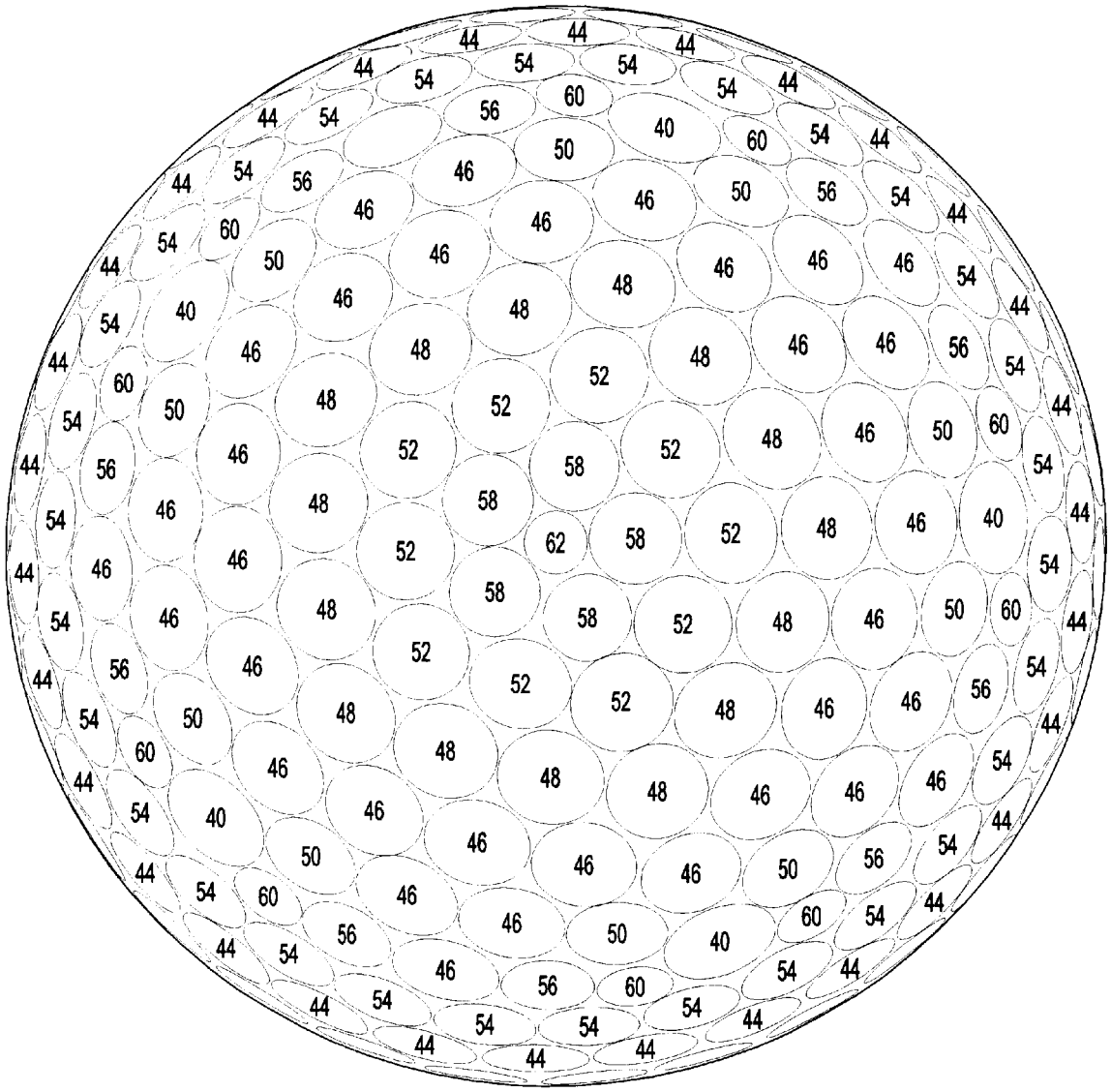
FIG. 4 is a polar view of the golf ball of FIG. 1.

As shown in FIGS. 2–4, the golf ball 20 has a surface 22. The golf ball 20 also has an equator 24 dividing the golf ball 20 into a first hemisphere 26 and a second hemisphere 28. A first pole 30 is located ninety degrees along a longitudinal arc from the equator 24 in the first hemisphere 26. A second pole 32 is located ninety degrees along a longitudinal arc from the equator 24 in the second hemisphere 28.

On the surface 22, in both hemispheres 26 and 28, are a plurality of dimples partitioned into multiple different sets of dimples. In a preferred embodiment, the number of dimples is 382, and the different sets of dimples are 12. Sets of dimples may vary primarily by diameter, however, the edge radius and depth may also vary for different sets of dimples. In a preferred embodiment there are 11 different sets of dimples by diameters.

In a preferred embodiment, there is a first plurality of dimples 40, a second plurality of dimples 42, a third plurality of dimples 44, a fourth plurality of dimples 46, a fifth plurality of dimples 48, a sixth plurality of dimples 50, a seventh plurality of dimples 52, an eighth plurality of dimples 54, a ninth plurality of dimples 56, a tenth plurality of dimples 58, an eleventh plurality of dimples 60 and a twelfth plurality of dimples 62.

In the preferred embodiment, each of the first plurality of dimples 40 has the largest diameter dimple, and each of the twelfth plurality of dimples 62 has the smallest diameter dimples. The diameter of a dimple is measured from a surface inflection point across the center of the dimple to an opposite surface inflection point. The surface inflection points are where the land surface 25 ends and where the dimples begin. Each of the second plurality of dimples 42 has a smaller diameter than the diameter of each of the first plurality of dimples 40. Each of the third plurality of dimples 44 has a smaller diameter than the diameter of each of the second plurality of dimples 42. Each of the fourth plurality of dimples 46 has a smaller diameter than the diameter of each of the third plurality of dimples 44. Each of the fifth plurality of dimples 48 has a diameter that is equal to or smaller than the diameter of each of the fourth plurality of dimples 46. Each of the sixth plurality of dimples 50 has a smaller diameter than the diameter of each of the fifth plurality of dimples 48. Each of the seventh plurality of dimples 52 has a smaller diameter than the diameter of each of the sixth plurality of dimples 50. Each of the eighth plurality of dimples 54 has a smaller diameter than the diameter of each of the seventh plurality of dimples 52. Each of the ninth plurality of dimples 56 has a smaller diameter than the diameter of each of the eighth plurality of dimples 54. Each of the tenth plurality of dimples 58 has a smaller diameter than the diameter of each of the ninth plurality of dimples 56. Each of the eleventh plurality of dimples 60 has a smaller diameter than the diameter of each of the tenth plurality of dimples 58. Each of the twelfth plurality of dimples 62 has a smaller diameter than the diameter of each of the eleventh plurality of dimples 60.

In a preferred embodiment, the fourth plurality of dimples 46 are the most numerous. The second plurality of dimples 42, the third plurality of dimples 44, and the eighth plurality of dimples 60 are the equally the second most numerous. The next most numerous are the fifth plurality of dimples 48. The next most numerous are the sixth plurality of dimples 50, the seventh plurality of dimples 52, the ninth plurality of dimples 56, and the eleventh plurality of dimples 60. The next most numerous are the first plurality of dimples 40 and the tenth plurality of dimples 58. The twelfth plurality of dimples 62 is the least.

Table One provides a description of the preferred embodiment. Table One includes the diameter (in inches), chord depth (in inches), entry angle, entry radius (in inches) and number of dimples.

TABLE One

| Dimple Set | # of Dimples | Dimple Diameter | Chord Depth | Entry Angle | Entry Radius |
|---|---|---|---|---|---|
| 1st | 10 | 0.186 | .0060 | 13.48 | .0255 |
| 2nd | 60 | 0.1698 | .0059 | 14.31 | .0382 |
| 3rd | 60 | 0.1688 | .0056 | 14.32 | .0279 |
| 4th | 70 | 0.1668 | .0061 | 14.39 | .0370 |
| 5th | 30 | 0.1668 | .0061 | 13.54 | .0273 |
| 6th | 20 | 0.161 | .0055 | 12.92 | .0286 |
| 7th | 20 | 0.1606 | .0058 | 14.67 | .0144 |
| 8th | 60 | 0.158 | .0057 | 15.02 | .0387 |
| 9th | 20 | 0.148 | .0055 | 14.18 | .0265 |
| 10th | 10 | 0.144 | .0059 | 15.07 | .0333 |
| 11th | 20 | 0.124 | .0055 | 14.95 | .0336 |
| 12th | 2 | 0.102 | .0065 | 21.17 | .0146 |

The two dimples of the twelfth set of dimples 62 are each disposed on respective poles 30 and 32. Each of the tenth set of dimples 58 is adjacent one of the twelfth set of dimples 62. The five dimples of the tenth set of dimples 58 that are disposed within the first hemisphere 26 are each an equal distance from the equator 24 and the first pole 30. The five dimples of the tenth set of dimples 58 that are disposed within the second hemisphere 28 are each an equal distance from the equator 24 and the second pole 32. These polar dimples 62 and 58 account for approximately 2% of the surface 22 of the golf ball 20.

FIGS. 5–10 illustrate the cross-section of a dimple for some of the different sets of dimples.

Figure 5:
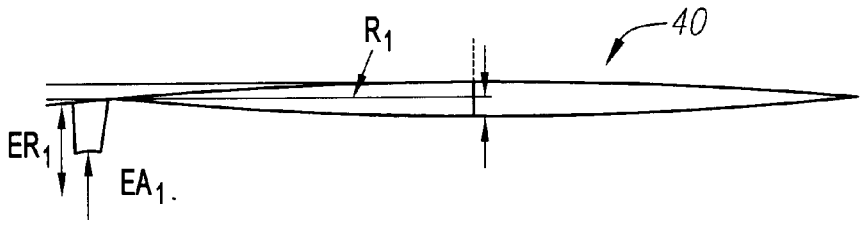
FIG. 5 is an enlarged cross-sectional view of a dimple of a first set of dimples of the golf ball of the present invention.

A cross-section of a dimple of the first set of dimples 40 is shown in FIG. 5. The radius $R_1$ of the dimple 40 is approximately 0.093 inch, the chord depth $C_1$ is approximately 0.006 inch, the entry angle $\theta_1$ is approximately 13.48 degrees, and the edge radius $ER_1$ is approximately 0.0255 inch. The ten dimples of the first set of dimples 40 cover approximately 3.8% of the surface 22 of the golf ball 20. The ten dimples of the first set of dimples 40 that are disposed within the first hemisphere 26 are each an equal distance from the equator 24 and the first pole 30. The ten dimples of the first set of dimples 40 that are disposed within the second hemisphere 28 are each an equal distance from the equator 24 and the second pole 32.

Figure 5A:
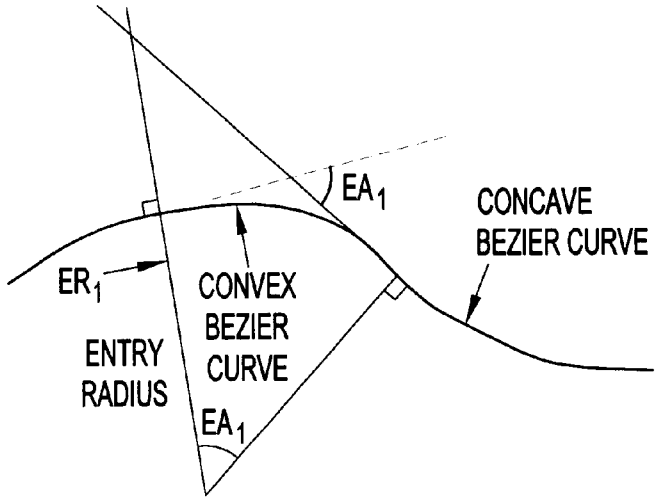
FIG. 5A is an isolated cross-sectional view to illustrate the definition of the entry radius.

Unlike the use of the term "entry radius" or "edge radius" in the prior art, the edge radius as defined herein is a value utilized in conjunction with the entry angle to delimit the concave and convex segments of the dimple contour. The first and second derivatives of the two Bézier curves are forced to be equal at this point defined by the edge radius and the entry angle, as shown in FIG. 5A. A more detailed description of the contour of the dimples is set forth in U.S. Pat. No. 6,331,150, entitled Golf Ball Dimples With Curvature Continuity, which is hereby incorporated by reference in its entirety.

Figure 6:
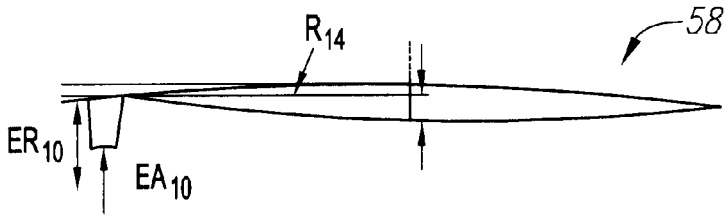
FIG. 6 is an enlarged cross-sectional view of a dimple of a tenth set of dimples of the golf ball of the present invention.

A cross-section of a dimple of the tenth set of dimples 58 is shown in FIG. 6. The radius $R_{10}$ of the dimple 58 is approximately 0.072 inch, the chord depth $C_{10}$ is approximately 0.0059 inch, the entry angle $\theta_{10}$ is approximately 15.7 degrees, and the edge radius $ER_{10}$ is approximately 0.0333 inch.

Figure 7:
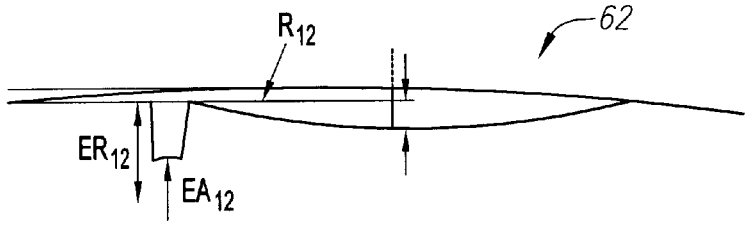
FIG. 7 is an enlarged cross-sectional view of a dimple of a twelfth set of dimples of the golf ball of the present invention.

A cross-section of a dimple of the twelfth set of dimples 62 is shown in FIG. 7. The radius $R_{12}$ of the dimple 62 is approximately 0.051 inch, the chord depth $C_{12}$ is approximately 0.0065 inches, the entry angle $\theta_{12}$ is approximately 21.7 degrees, and the edge radius $ER_{12}$ is approximately 0.0146 inch.

Figure 8:
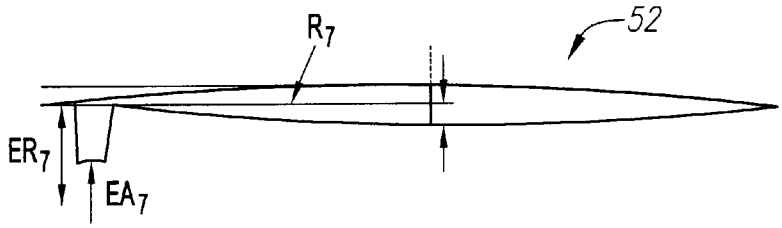
FIG. 8 is an enlarged cross-sectional view of a dimple of a seventh set of dimples of the golf ball of the present invention.

A cross-section of a dimple of the seventh set of dimples 52 is shown in FIG. 8. The radius $R_7$ of the dimple 52 is approximately 0.0803 inch, the chord depth $C_7$ is approximately 0.0058 inch, the entry angle $\theta_6$ is approximately 14.67 degrees, and the edge radius $ER_7$ is approximately 0.0144 inch. The ten dimples of the seventh set of dimples 52 that are disposed within the first hemisphere 26 are each an equal distance from the equator 24 and the first pole 30. The ten dimples of the seventh set of dimples 52 that are disposed within the second hemisphere 28 are each an equal distance from the equator 24 and the second pole 32.

Figure 9:
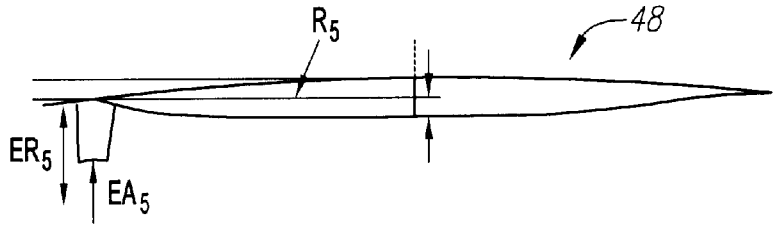
FIG. 9 is an enlarged cross-sectional view of a dimple of a fifth set of dimples of the golf ball of the present invention.

All of the fifth set of dimples 48 are adjacent to at least one of the seventh set of dimples 52. The thirty dimples of the fifth set of dimples 48 cover approximately 3.5% of the surface 22 of the golf ball 20. The fifteen dimples of the fifth set of dimples 48 that are disposed within the first hemisphere 26 are each an equal distance from the first pole 30. The fifteen dimples of the fifth set of dimples 48 that are disposed within the second hemisphere 28 are each an equal distance from the second pole 32. A cross-section of a dimple of the fifth set of dimples 48 is shown in FIG. 9. The radius $R_5$ of the dimple 48 is approximately 0.0834 inch, the chord depth $C_5$ is approximately 0.0061 inch, the entry angle $\theta_5$ is approximately 13.54 degrees, and the edge radius $ER_5$ is approximately 0.0273 inches.

Figure 10:
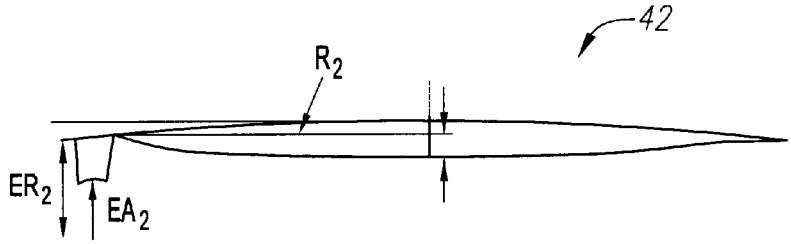
FIG. 10 is an enlarged cross-sectional view of a dimple of a second set of dimples of the golf ball of the present invention.

A cross-section of a dimple of the second set of dimples 42 is shown in FIG. 10. The radius $R_2$ of the dimple 42 is approximately 0.0834 inch, the chord depth $C_2$ is approximately 0.0059 inch, the entry angle $\theta_2$ is approximately 14.31 degrees, and the edge radius $ER_2$ is approximately 0.0382 inch. The sixty dimples of the second set of dimples 42 are the most influential of the different sets of dimples 40–62 due to their number, size and placement on the surface 22 of the golf ball 20. The sixty dimples of the second set of dimples 42 cover approximately 12% of the surface 22 of the golf ball 20. The thirty dimples of the second set of dimples 42 that are disposed within the first hemisphere 26 are disposed in the first row 80 above the equator 24. Similarly, the thirty dimples of the second set of dimples 42 that are disposed within the second hemisphere 28 are disposed in the first row 90 below the equator 24.

The one-hundred eighty dimples of the second, third and eighth sets of dimples 42, 44 and 54 are the most influential of the different sets of dimples 40–62 due to their number, size and placement on the surface 22 of the golf ball 20 near the equator. The one-hundred eighty dimples of the second, third and eighth sets of dimples 42, 44 and 54 cover approximately 50% of the surface 22 of the golf ball 20.

Figure 11:
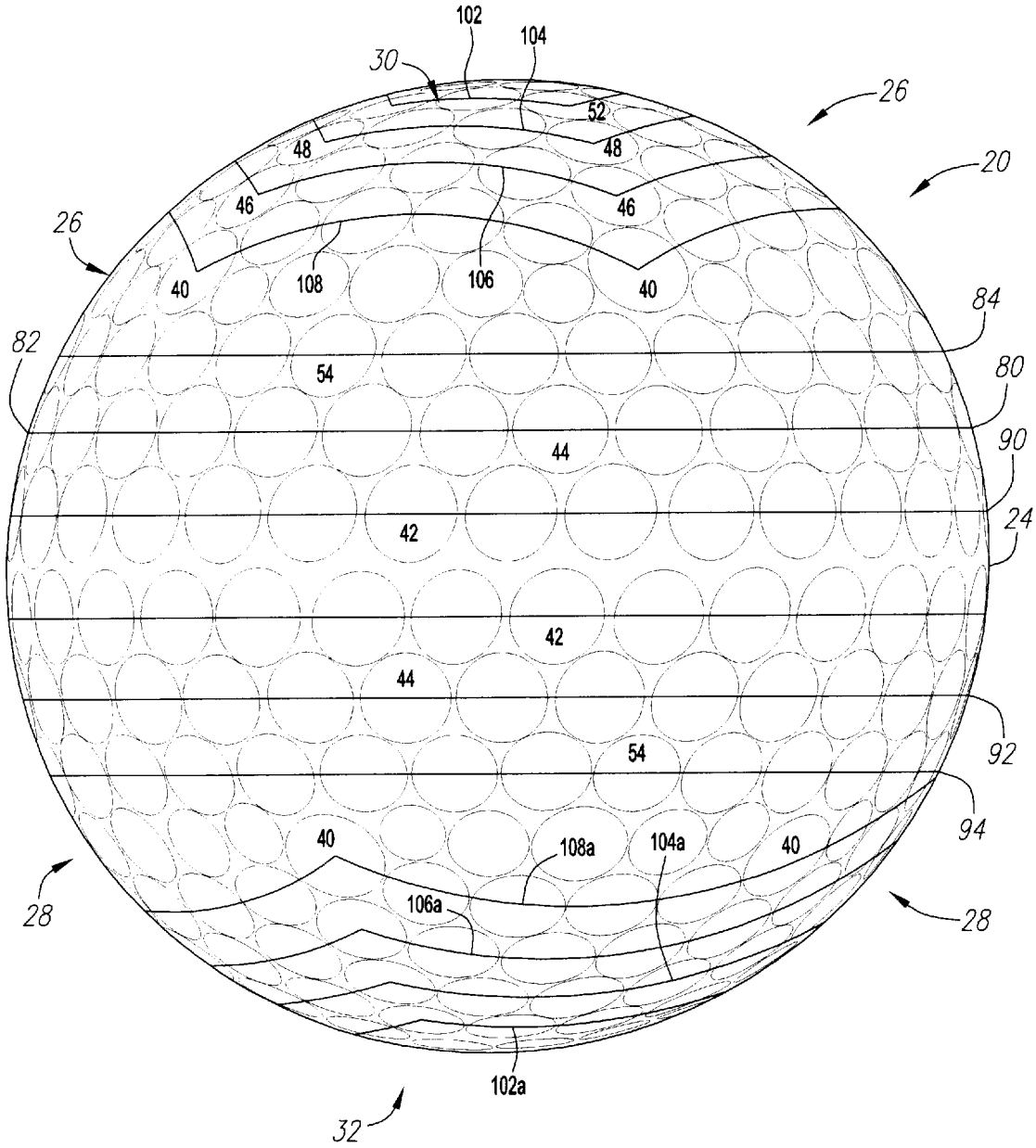
FIG. 11 is the view of FIG. 1 illustrating the rows of dimples.

As best illustrated in FIG. 11, each hemisphere 26 and 28 begins with three rows from the equator 24. The first row 80 of the first hemisphere 26 and the first row 90 of the second hemisphere 28 are composed of the second set of dimples 42. The second row 82 of the first hemisphere 26 and the second row 92 of the second hemisphere 28 are composed of the third set of dimples 44. The third row 84 of the first hemisphere 26 and the third row 94 of the second hemisphere 28 are composed of the eight set of dimples 54. This pattern of rows is utilized to achieve greater surface area coverage of the dimples on the golf ball 20. However, as mentioned previously, conventional teaching would dictate that additional rows of smaller diameter dimples should be utilized to achieve greater surface area coverage. However, the dimple pattern of the present invention transitions from rows of equal dimples into a pentagonal region 98.

Figure 12:
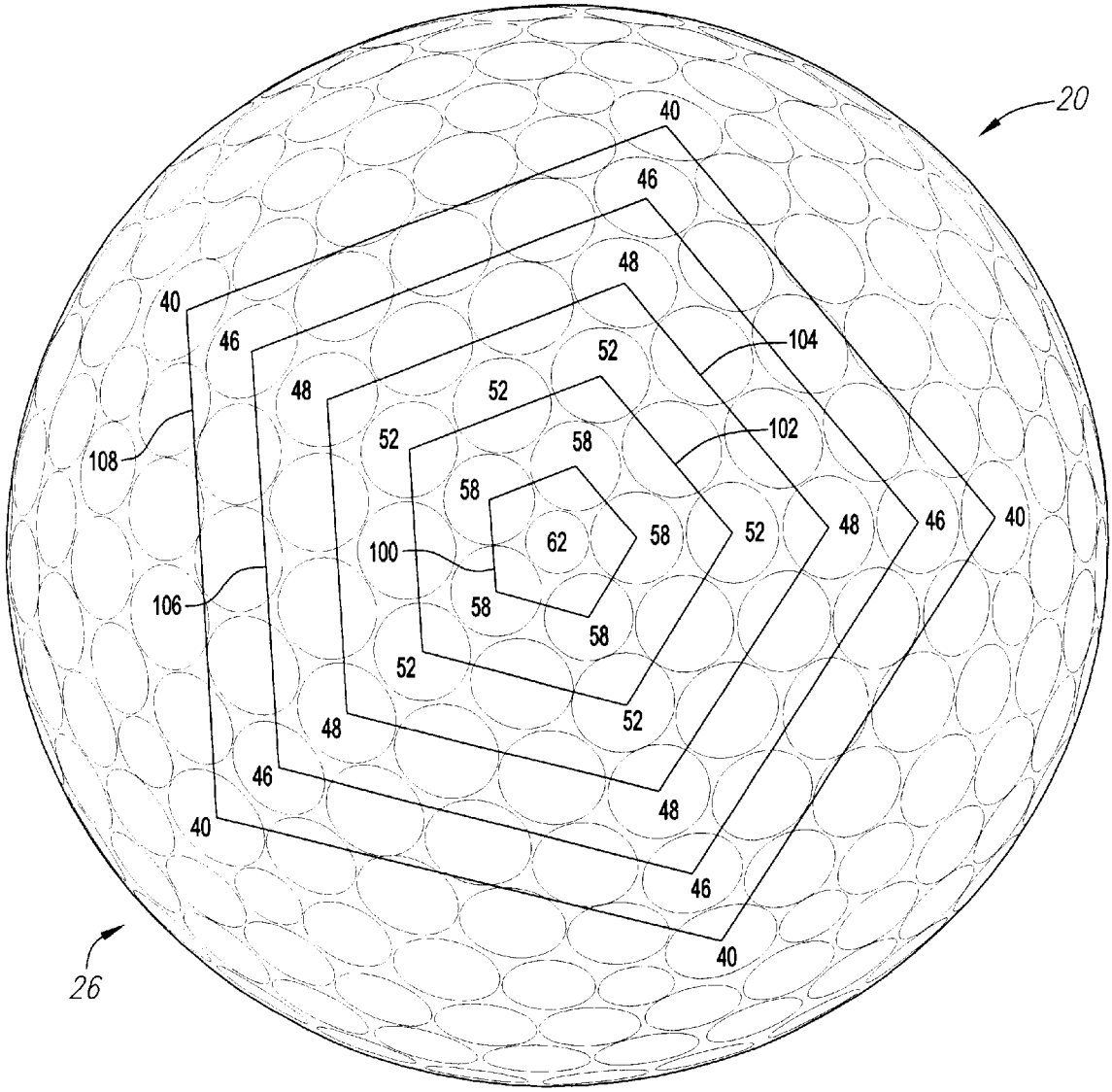
FIG. 12 is the view of FIG. 1 illustrating the transition region of dimples.

The pentagonal region 98 is best seen in FIG. 12. A similar pentagonal region 98*a*, not shown, is disposed about the second pole 32. The pentagonal region 98 has five pentagons 100, 102, 104, 106 and 108 expanding from the first pole 30. Similar pentagons 100*a*, 102*a*, 104*a*, 106*a* and 108*a* expand from the second pole 32.

The first pentagon 100 consists of the tenth set of dimples 58. The second pentagon 102 consists of the seventh set of dimples 52. The third pentagon 104 consists of the fifth set of dimples 48. The fourth pentagon 106 consists of the fourth set of dimples 46. The fifth pentagon 108 consists of the first set of dimples 40, the sixth set of dimples 50, and the fourth set of dimples 46. However, the greater fifth pentagon 108' would include the fifth pentagon 108 and all dimples disposed between the third row 84 and the fifth pentagon 108. The pentagonal region 98 allows for the greater surface area of the dimple pattern of the present invention.

Figure 13:
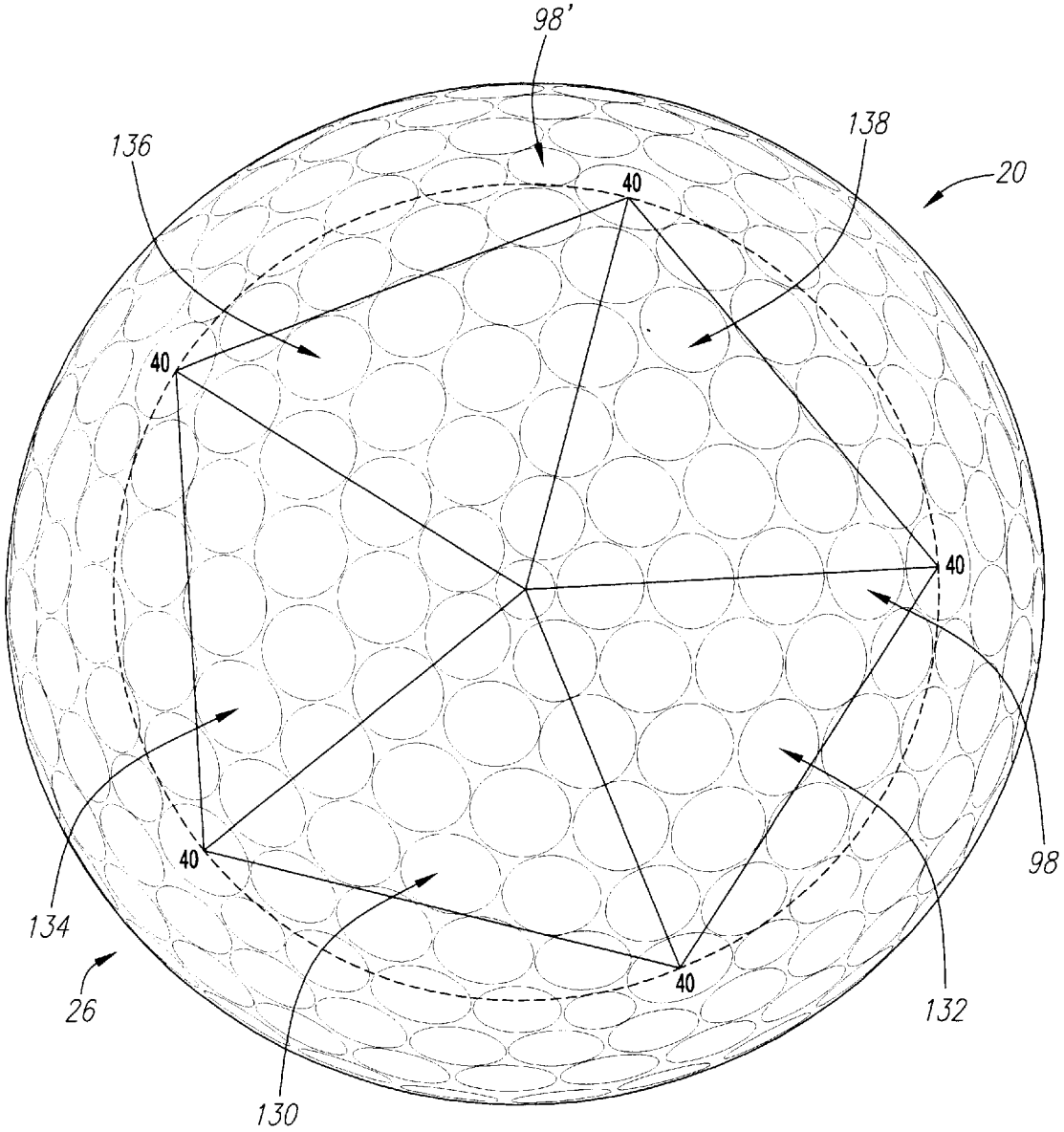
FIG. 13 is the view of FIG. 2 illustrating the cascading pentagons of dimples.

FIG. 13 illustrates five triangles 130–138 that compose the pentagonal region 98. Dashed line 140 illustrates the extent of the greater pentagonal region 98' which overlaps with the transition latitudinal region 70.

Figure 14:
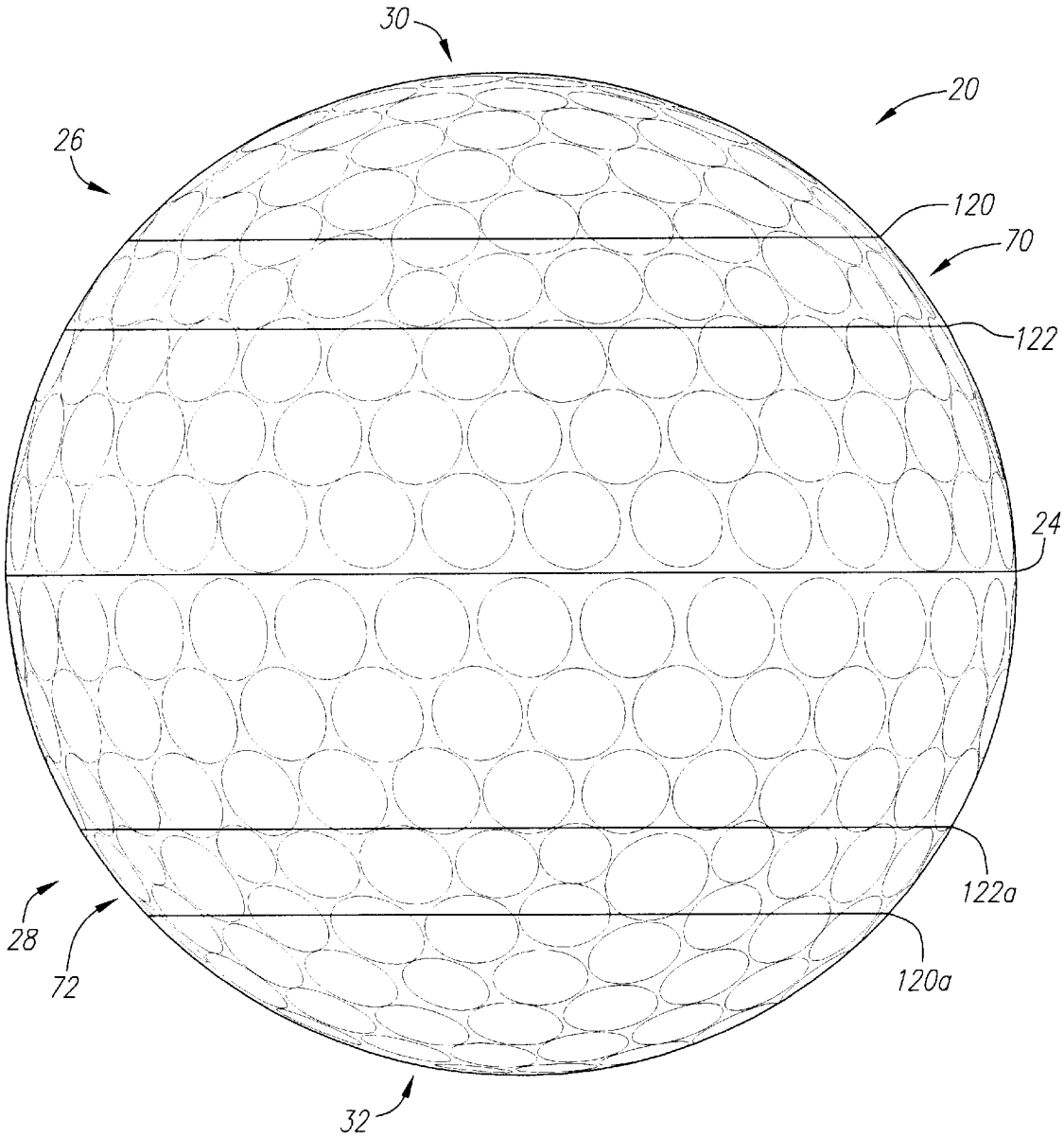
FIG. 14 is the view of FIG. 2 illustrating the single encompassing pentagon of dimples.

As best illustrated in FIG. 14, all of the dimples of the ninth set of dimples 56 and the eleventh set of dimples 60 are disposed within the transition latitudinal regions 70 and 72. The transition latitudinal regions 70 and 72 transition the dimple pattern of the present invention from the rows 80, 82, 84, 90, 92 and 94 to the pentagonal regions 98 and 98*a*. Each of the transition latitudinal regions 70 and 72 cover a circumferential area between 40 to 60 longitudinal degrees from the equator 24 in their respective hemispheres 26 and 28. The first transition latitudinal region 70 has a polar boundary 120 at approximately 60 longitudinal degrees from the equator 24, and an equatorial boundary 122 at approximately 40 longitudinal degrees from the equator 24. Similarly, the second transition latitudinal region 72 has a polar boundary 120*a* at approximately 60 longitudinal degrees from the equator 24, and an equatorial boundary 122*a* at approximately 40 longitudinal degrees from the equator 24.

Alternative embodiments of the dimple pattern of the present invention may variations in the number of dimples, diameters, depths, entry angle and/or entry radius. Most common alternatives will not have any dimples at the poles 30 and 32. Other common alternatives will have the same number of dimples, but with less variation in the diameters.

The force acting on a golf ball in flight is calculated by the following trajectory equation:

$$F = F_L + F_D + G \tag{A}$$

wherein F is the force acting on the golf ball; $F_L$ is the lift; $F_D$ is the drag; and G is gravity. The lift and the drag in equation A are calculated by the following equations:

$$F_L = 0.5 C_L A \rho v^2 \tag{B}$$

$$F_D = 0.5 C_D A \rho v^2 \tag{C}$$

wherein $C_L$ is the lift coefficient; $C_D$ is the drag coefficient; A is the maximum cross-sectional area of the golf ball; ρ is the density of the air; and ν is the golf ball airspeed.

The drag coefficient, $C_D$, and the lift coefficient, $C_L$, may be calculated using the following equations:

$$C_D = 2F_D / A\rho v^2 \tag{D}$$

$$C_L = 2F_L / A\rho v^2 \tag{E}$$

The Reynolds number R is a dimensionless parameter that quantifies the ratio of inertial to viscous forces acting on an object moving in a fluid. Turbulent flow for a dimpled golf ball occurs when R is greater than 40000. If R is less than 40000, the flow may be laminar. The turbulent flow of air about a dimpled golf ball in flight allows it to travel farther than a smooth golf ball.

The Reynolds number R is calculated from the following equation:

$$R = vD\rho / \mu \tag{F}$$

wherein ν is the average velocity of the golf ball; D is the diameter of the golf ball (usually 1.68 inches); ρ is the density of air (0.00238 slugs/ft$^3$ at standard atmospheric conditions); and $\mu$ is the absolute viscosity of air ($3.74\times10^{-7}$ lb*sec/ft$^2$ at standard atmospheric conditions). A Reynolds number, R, of 180,000 for a golf ball having a USGA approved diameter of 1.68 inches, at standard atmospheric conditions, approximately corresponds to a golf ball hit from the tee at 200 ft/s or 136 mph, which is the point in time during the flight of a golf ball when the golf ball attains its highest speed. A Reynolds number, R, of 70,000 for a golf ball having a USGA approved diameter of 1.68 inches, at standard atmospheric conditions, approximately corresponds to a golf ball at its apex in its flight, 78 ft/s or 53 mph, which is the point in time during the flight of the golf ball when the travels at its slowest speed. Gravity will increase the speed of a golf ball after its reaches its apex.

Figure 15:
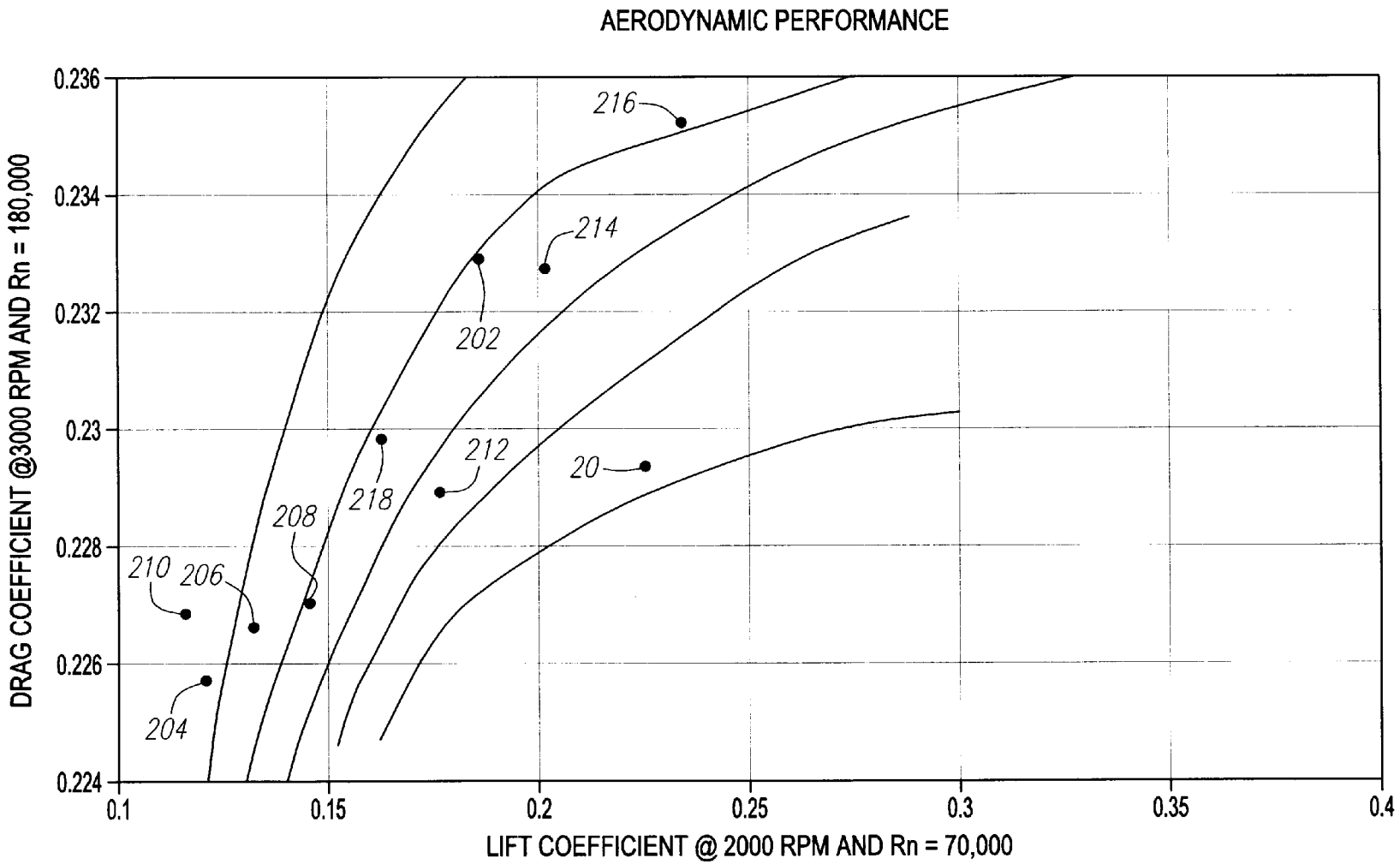
FIG. 15 is a graph of the lift coefficient for a Reynolds number of 70,000 at 2000 rotations per minute (x-axis) versus the drag coefficient for a Reynolds number of 180, 000 at 3000 rotations per minute (y-axis).

FIG. 15 is a graph of the lift coefficient for a Reynolds number of 70,000 at 2000 rotations per minute versus the drag coefficient for a Reynolds number of 180,000 at 3000 rotations per minute for a golf ball 20 with the dimple pattern of the present invention thereon as compared to the Titleist HP DISTANCE 202, the Titleist HP ECLIPSE 204, the SRI Maxfli HI-BRD (from Japan) 206, the Wilson CYBERCORE PRO DISTANCE 208, the Titleist PRO V1 210, the Bridgestone TOUR STAGE MC392 (from Japan) 212, the Precept MC LADY 214, the Nike TOUR ACCURACY 216, and the Titlelist DT DISTANCE 218.

The golf balls 20 with the dimple pattern of the present invention were constructed as set forth in co-pending U.S. patent application Ser. No. 09/768,846, filed on Jan. 23, 2001 for a Golf Ball which pertinent parts are hereby incorporated by reference. The aerodynamics of the dimple pattern of the present invention provides a greater lift with a reduced drag thereby translating into a golf ball 20 that travels a greater distance than golf balls of similar constructions.

As compared to other golf balls, the golf ball 20 of the present invention is the only one that combines a lower drag coefficient at high speeds, and a greater lift coefficient at low speeds. Specifically, as shown in FIG. 15, none of the other golf balls have a lift coefficient, $C_L$, greater than 0.19 at a Reynolds number of 70,000, and a drag coefficient $C_D$ less than 0.232 at a Reynolds number of 180,000. For example, while the Nike TOUR ACCURACY 216 has a $C_L$ greater than 0.19 at a Reynolds number of 70,000, its $C_D$ is greater than 0.232 at a Reynolds number of 180,000. Also, while the Titleist DT DISTANCE 218 has a drag coefficient $C_D$ less than 0.232 at a Reynolds number of 180,000, its $C_L$ is less than 0.19 at a Reynolds number of 70,000. Further, the golf ball 20 of the present invention is the only golf ball that has a lift coefficient, $C_L$, greater than 0.20 at a Reynolds number of 70,000, and a drag coefficient $C_D$ less than 0.235 at a Reynolds number of 180,000. Yet further, the golf ball 20 of the present invention is the only golf ball that has a lift coefficient, $C_L$, greater than 0.19 at a Reynolds number of 70,000, and a drag coefficient $C_D$ less than 0.229 at a Reynolds number of 180,000. More specifically, the golf ball 20 of the present invention is the only golf ball that has a lift coefficient, $C_L$, greater than 0.21 at a Reynolds number of 70,000, and a drag coefficient $C_D$ less than 0.230 at a Reynolds number of 180,000. Even more specifically, the golf ball 20 of the present invention is the only golf ball that has a lift coefficient, $C_L$, greater than 0.22 at a Reynolds number of 70,000, and a drag coefficient $C_D$ less than 0.230 at a Reynolds number of 180,000.

In this regard, the Rules of Golf, approved by the United States Golf Association ("USGA") and The Royal and Ancient Golf Club of Saint Andrews, limits the initial velocity of a golf ball to 250 feet (76.2 m) per second (a two percent maximum tolerance allows for an initial velocity of 255 per second) and the overall distance to 280 yards (256 m) plus a six percent tolerance for a total distance of 296.8 yards (the six percent tolerance may be lowered to four percent). A complete description of the Rules of Golf are available on the USGA web page at www.usga.org. Thus, the initial velocity and overall distance of a golf ball must not exceed these limits in order to conform to the Rules of Golf. Therefore, the golf ball 20 has a dimple pattern that enables the golf ball 20 to meet, yet not exceed, these limits.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A golf ball having a surface, the golf ball comprising:

a first plurality of dimples disposed on the surface, each of the first plurality of dimples having a first diameter;

a second plurality of dimples disposed on the surface, each of the second plurality of dimples having a second diameter, the second diameter less than the first diameter;

a third plurality of dimples disposed on the surface, each of the third plurality of dimples having a third diameter, the third diameter less than the second diameter;

a fourth plurality of dimples disposed on the surface, each of the fourth plurality of dimples having a fourth diameter, the fourth diameter less than the third diameter;

a fifth plurality of dimples disposed on the surface, each of the fifth plurality of dimples having a fifth diameter, the fifth diameter less than the fourth diameter;

a sixth plurality of dimples disposed on the surface, each of the sixth plurality of dimples having a sixth diameter, the sixth diameter less than the fifth diameter;

a seventh plurality of dimples disposed on the surface, each of the seventh plurality of dimples having a seventh diameter, the seventh diameter less than the sixth diameter;

an eighth plurality of dimples disposed on the surface, each of the eighth plurality of dimples having a eighth diameter, the eighth diameter less than the seventh diameter;

a ninth plurality of dimples disposed on the surface, each of the ninth plurality of dimples having a ninth diameter, the ninth diameter less than the eighth diameters a tenth plurality of dimples disposed on the surface[] each of the tenth plurality of dimples having a tenth diameter, the tenth diameter less than the ninth diameter, and an eleventh plurality of dimples disposed on the surface, each of the eleventh plurality of dimples having a eleventh diameter, the eleventh diameter less than the tenth diameter;

wherein the first, second, third, fourth, fifth, sixth, seventh, eighth, ninth, tenth and eleventh pluralities of dimples total 382 dimples and cover at least 87% of the surface of the golf ball, and wherein at least one of the first, second, third, fourth, fifth, sixth, seventh, eighth, ninth, tenth and eleventh pluralities of dimples comprises at least two different sets of dimples which vary in chord depth, edge radius or edge angle while having the same diameter.

2. The golf ball according to claim 1 wherein the eleventh diameter is less than 0.124 inch and the first diameter is greater than 0.168 inch.

3. A golf ball having a surface, the golf ball comprising:

a first plurality of dimples disposed on the surface, each of the first plurality of dimples having a first diameter;

a second plurality of dimples disposed on the surface, each of the second plurality of dimples having a second diameter, the second diameter less than the first diameter;

a third plurality of dimples disposed on the surface, each of the third plurality of dimples having a third diameter, the third diameter less than the second diameter;

a fourth plurality of dimples disposed on the surface, each of the fourth plurality of dimples having a fourth diameter, the fourth diameter less than the third diameter;

a fifth plurality of dimples disposed on the surface, each of the fifth plurality of dimples having a fifth diameter, the fifth diameter less than the fourth diameter a sixth plurality of dimples disposed on the surface, each of the sixth plurality of dimples having a sixth diameter, the sixth diameter less than the fifth diameter;

a seventh plurality of dimples disposed on the surface, each of the seventh plurality of dimples having a seventh diameter, the seventh diameter less than the sixth diameter;

an eighth plurality of dimples disposed on the surface, each of the eighth plurality of dimples having a eighth diameter, the eighth diameter less than the seventh diameter;

a ninth plurality of dimples disposed on the surface, each of the ninth plurality of dimples having a ninth diameter, the ninth diameter less than the eighth diameter;

a tenth plurality of dimples disposed on the surface, each of the tenth plurality of dimples having a tenth diameter, the tenth diameter less than the ninth diameter; and an eleventh plurality of dimples disposed on the surface, each of the eleventh plurality of dimples having a eleventh diameter, the eleventh diameter less than the tenth diameter;

wherein the first, second, third, fourth, fifth, sixth, seventh, eighth, ninth, tenth and eleventh pluralities of dimples cover at least 87% of the surface of the golf ball and wherein each of the first plurality of dimples disposed on a first hemisphere of the golf ball lies an equal distance from a first pole, and each of the first plurality of dimples disposed on a second hemisphere of the golf ball lies an equal distance from a second pole.

4. The golf ball according to claim I wherein 180 dimples of the 382 dimples lie within a latitudinal region 40 to 60 degrees above and below an equator of the golf ball.

5. A golf ball comprising:

a core composed of a polybutadiene material and having a diameter of 1.50 inches to 156 inches;

a cover encompassing the core, the cover composed of an ionomer material and having a thickness of 0.05 inch to 0.10 inch, the cover having a surface, the surface comprising at least 382 dimples, wherein the at least 382 dimples are partitioned into at least eleven different sets of dimples, each of the eleven different sets of dimples having a different diameter than any other set of dimples, and wherein the at least 382 dimples cover at least 87% of the surface of the coven wherein the golf ball has a lift coefficient greater than 0.19 at a Reynolds number of 70,000 arid 2000 rotations per minute, and a drag coefficient less than 0.230 at a Reynolds number of 180,000 and 3000 rotations per minute.

6. A golf ball having a surface, the golf ball comprising multiple sets of dimples wherein the golf ball has a lift coefficient greater than 0.19 at a Reynolds number of 70,000 and 2000 rotations per minute, and a drag coefficient less than 0.230 at a Reynolds number of 180,000 and 3000 rotations per minute.

7. The golf ball according to claim 6 wherein the multiple sets of dimples comprises at least eleven sets of dimples, each of the sets of dimples having a diameter that is different than any other set of dimples.

8. A golf ball having a surface, the golf ball comprising multiple sets of dimples wherein the golf ball has a lift coefficient greater than 0.20 at a Reynolds number of 70,000 and 2000 rotations per minute, and a drag coefficient less than 0.235 at a Reynolds number of 180,000 and 3000 rotations per minute.

9. A golf ball having a surface, the golf ball comprising multiple sets of dimples wherein the golf ball has a lift coefficient greater than 0.22 at a Reynolds number of 70,000 and 2000 rotations per minute, and a drag coefficient less than 0.230 at a Reynolds number of 180,000 and 3000 rotations per minute.

* * * * *